US008440054B2

(12) United States Patent
Svenka et al.

(10) Patent No.: US 8,440,054 B2
(45) Date of Patent: May 14, 2013

(54) CALENDER FOR CALENDERING A PAPER WEB

(75) Inventors: Peter Svenka, Grefrath (DE); Bernhard Brendel, Tönisvorst (DE); Eduard Davydenko, Grefrath-Oedt (DE)

(73) Assignee: Andritz Kusters GmbH, Krefeld (DE)

( * ) Notice: Subject to any disclaimer, the term of this patent is extended or adjusted under 35 U.S.C. 154(b) by 0 days.

(21) Appl. No.: 13/379,586

(22) PCT Filed: Jun. 25, 2010

(86) PCT No.: PCT/EP2010/003900

§ 371 (c)(1),
(2), (4) Date: Dec. 20, 2011

(87) PCT Pub. No.: WO2011/000530

PCT Pub. Date: Jan. 6, 2011

(65) Prior Publication Data

US 2012/0103552 A1 May 3, 2012

(30) Foreign Application Priority Data

Jun. 30, 2009 (EP) ..... 09008506

(51) Int. Cl.
*D21F 1/36* (2006.01)

(52) U.S. Cl.
USPC ..... 162/193; 162/290; 100/162 R

(58) Field of Classification Search ..... 162/290, 162/361, 360.3, 193; 100/162 R, 173, 35, 100/38, 161
See application file for complete search history.

(56) References Cited

U.S. PATENT DOCUMENTS

| | | | | |
|---|---|---|---|---|
| 6,531,183 | B1 * | 3/2003 | Cason et al. | 427/361 |
| 6,589,388 | B1 * | 7/2003 | Nissinen | 162/135 |
| 6,827,009 | B2 * | 12/2004 | Koivukunnas et al. | 100/35 |
| 6,905,575 | B2 * | 6/2005 | Linnonmaa et al. | 162/361 |
| 7,340,998 | B2 * | 3/2008 | Kyytsonen | 100/161 |
| 2003/0024672 | A1 * | 2/2003 | Viljanmaa et al. | 162/194 |
| 2005/0139094 | A1 * | 6/2005 | Kyytsonen | 100/161 |

FOREIGN PATENT DOCUMENTS

| | | | |
|---|---|---|---|
| EP | 0886695 | B1 | 5/2002 |
| WO | WO01/71091 | A1 | 9/2001 |

OTHER PUBLICATIONS

English translation of International Preliminary Report on Patentability dated Sep. 25, 2012.

* cited by examiner

*Primary Examiner* — Mark Halpern
(74) *Attorney, Agent, or Firm* — Kilpatrick Townsend & Stockton LLP

(57) ABSTRACT

A calender (1) for calendering a paper web (2), in particular made from paper suitable for gravure printing, having at least one roll stack which in each case has an upper and a lower end roll (4.1, 4.2) and intermediate rolls (5.1, 5.2, 5.3, 5.4), one of the two end rolls (4.1) delimits a first working nip (3) of the roll stack depending on the guidance of the paper web (2), and the rolls (4.1, 4.2, 5.1, 5.2, 5.3, 5.4) are hard rolls (4.1, 5.2, 5.4) and soft rolls (5.1, 5.3, 4.2) in order to form loadable working nips in the form of soft nips, the end roll (4.1) which delimits the first working nip (3) being a hard, heated roll, the diameter of which is greater than that of a hard, heated intermediate roll (5.2, 5.4) and the outer wall (9) of which forms one of two contact faces (9, 10) of a web treatment nip (8) which is arranged upstream of the first working nip (3), and the other contact face (10) being formed by a belt (14) which circulates on guide rolls (11, 12, 13).

17 Claims, 2 Drawing Sheets

CALENDER FOR CALENDERING A PAPER WEB

Figure 1:
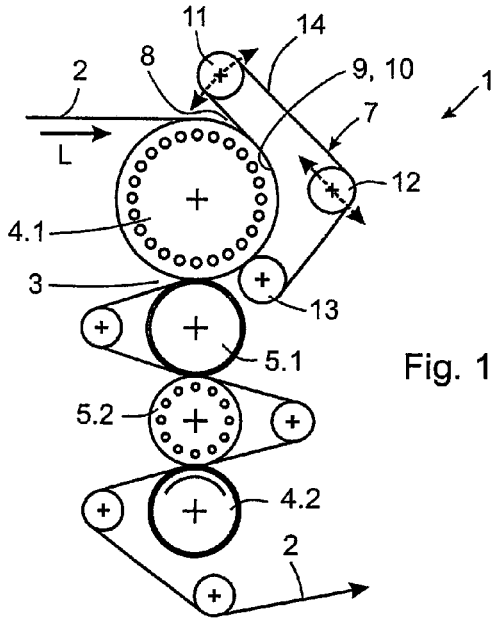

This application is a 371 of PCT/EP2010/003900 filed 25 Jun. 2010.

The invention relates to a calender for calendering a paper web, in particular made from paper suitable for gravure printing, in accordance with the preamble of claim 1.

Paper webs are calendered in order to improve the surface quality. Papers which are suitable for gravure printing and belong to the high quality papers require a particularly great smoothness. EP 0 886 695 B1 has disclosed a calender for treating a paper web, which calender has a plurality of rolls which form what are known as soft nips between in each case one hard and one soft roll as working nips. The plurality of working nips make calendering possible to high smoothness values which are crucial for a satisfactory printed result.

At high machine speeds during online or offline operation, however, high temperatures have to be selected to this end. Said high temperatures can lead to hornification on the surface of the paper web which has a disadvantageous effect on the gravure printing. Furthermore, great heat losses to the surroundings occur at high temperatures of the roll surface of the heated rolls.

It is therefore an object of the present invention to provide a calender which calenders a paper web to a great extent and in the process can be operated in a manner which saves costs and energy.

This object is achieved by the features of claim 1.

As a result, a calender is provided, in which, before entering the first working nip, the paper web runs through a pretreatment section in order to produce an optimum temperature profile during calendering in the working nips. To this end, the roll surface temperature of the heated rolls of a roll stack needs only to be selected to be slightly higher than the plasticization temperature of the respective paper web at a selectable moisture content. For example, calendering can be carried out in the working nips at a roll surface temperature which to this extent is higher only by from 10 to 30° C.

The greater diameter of the end roll which delimits the respectively first nip in comparison with a hard, heated intermediate roll makes it possible to construct a treatment section, the length of which is great in comparison with the nip length. As a result, the increase of the calendering effect in multinip calenders with soft nips and with extended soft nips (broad nip) is possible.

This applies, in particular, to SC-A, SC-B and LWC paper. The energy saving results from reduced heat emission and reduced forced convection of the heated rolls. In addition, the degree of efficiency of the heat transfer is increased, since the amount of heat loss is reduced.

The increased dwell time in the web treatment nip in conjunction with a preferably elastic surface of the circulating belt improves the heating of the paper web considerably. Satisfactory heat transfer is ensured, since the paper web is pressed uniformly against the heated roll, with the result that, for example, air cushions from unevennesses of the paper web which might impede the heat transfer are avoided largely. The advantages of the proposed calender therefore result from the extended dwell section for heating the web in conjunction with the configuration of the circulating belt, immediately before the paper web runs through the working nips of a roll stack.

As a result of extended heating of the paper web in the web treatment nip, uniform heating of the paper web down to the technologically required depth is possible. To this end, roll surface temperatures in the range from 80° C. to 160° C. are generally sufficient. The level of the temperature is reduced in favor of an extension of the time period of the temperature action. The reduction in the level of the temperature for the thermomechanical calendering operation is then determined substantially only by the plasticization temperature of the fibrous materials used of a paper web and their moisture content. Here, the preferably elastic surface of the belt ensures a uniform contact pressure and therefore uniform heat transfer from the heated roll to the paper web.

The contact pressure is preferably set by the tensioning of the belt. This tangential tensioning of the belt loads the belt, which usually comprises a plastic, a rubber, a plastic coated carrier material or a rubber coated carrier material, to a far lesser extent than radial tensioning. In the case of radial tensioning, the plastic tends toward delamination of a layer assembly. The thermal loading of the belt is low, with the result that the belt has a long service life.

The calender according to the invention has succeeded in realizing the advantages and effects to be expected by a simultaneous use of pressure and temperature in the nip in a manner which saves costs and energy in the calendering operation.

A dwell time in the web treatment nip required to achieve the desired penetration depth of the heat can be optimized by adjusting the pressing length of the belt against the circumference of the heated roll by means of guide rolls.

A controlled local pressure increase in the web treatment nip can preferably be set by guide rolls for the circulating belt additionally working as pressing rolls.

Further refinements of the invention can be gathered from the following description and the subclaims.

Figure 2:
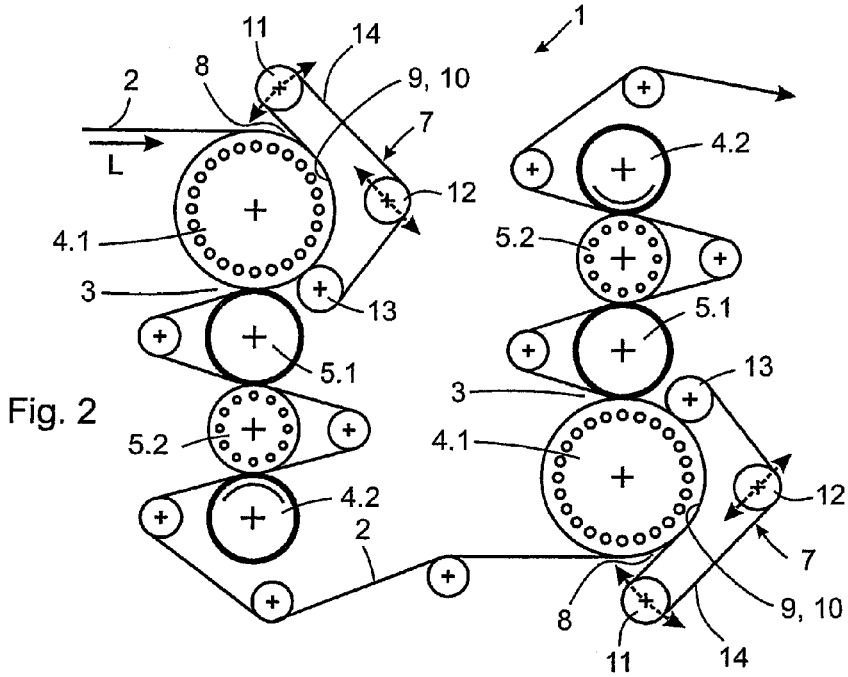
Figure 3:
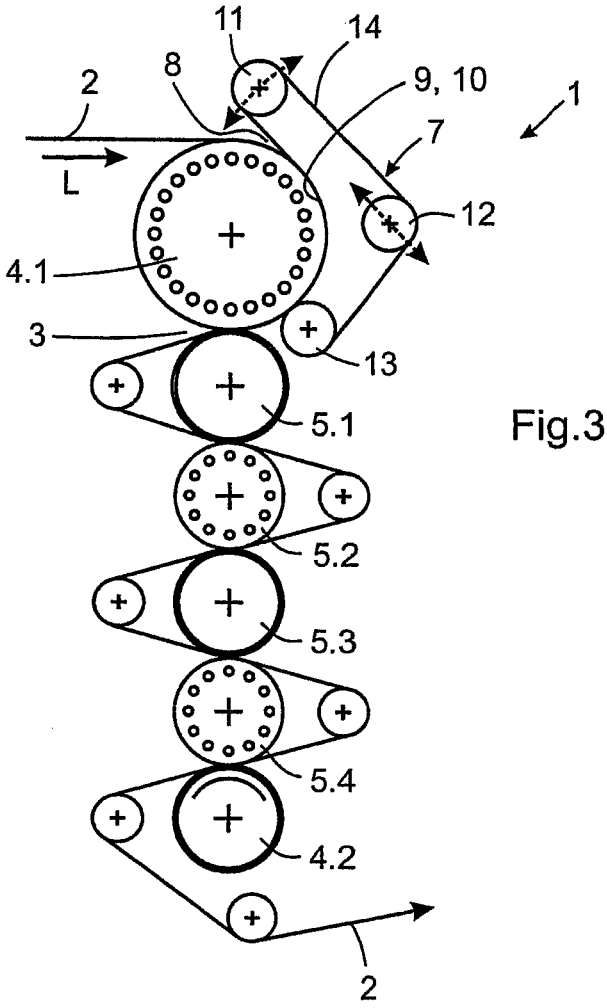

In the following text, the invention will be explained in greater detail using the exemplary embodiments which are shown in the appended figures, in which:

FIG. 1 diagrammatically shows a calender according to a first exemplary embodiment, FIG. 2 diagrammatically shows a calender according to a second exemplary embodiment, and FIG. 3 diagrammatically shows a calender according to a third exemplary embodiment.

The invention relates to a calender 1 for calendering a paper web 2, in particular made from paper which is suitable for gravure printing. FIG. 1 diagrammatically shows a calender according to a first exemplary embodiment having at least one roll stack which in each case has an upper 4.1 and a lower end roll 4.2 and intermediate rolls 5.1, 5.2. Depending on the guidance of the paper web 2 in the running direction L, one of the two end rolls, here the upper end roll 4.1, delimits a first working nip 3 of the roll stack. The roll stack comprises a plurality of rolls 4.1, 4.2, 5.1, 5.2 which are configured as hard rolls 4.1, 5.2 and soft rolls 5.1, 4.2 in order to form loadable working nips in the form of soft nips. The end roll 4.1 which delimits the first working nip 3 is a hard, heated roll, the diameter of which is greater than that of a hard, heated intermediate roll 5.2. Furthermore, the outer wall of the end roll 4.1 forms a contact face 10 of a web treatment nip 8 which is arranged upstream of the first working nip 3. The other contact face 9 of the web treatment nip 8 is formed by a belt 14 which circulates on guide rolls 11, 12, 13. Two contact faces 9, 10 are therefore provided which form an extended treatment section, the web treatment nip 8.

The web treatment nip 8 preferably extends along an angle of the wrap of the hard, heated end roll 4.1. The circulating belt 14 has an elastic surface on the side which faces the paper web 2. The guide rolls 11, 12, 13 control belt tensioning of the belt 14 for pressure loading of the paper web 2 in the web treatment nip 8.

The diameter of the end roll 4.1 which delimits the first working nip 3 lies in the range from 1.2 m to 2.0 m. The diameter of a hard, heated intermediate roll 5.2 lies in the range from 0.6 to 1.2 m. The end rolls 4.1, 4.2 are preferably controlled deflection rolls for the simultaneous regulation of the property profiles of the web 2 in the transverse direction. All the rolls 4.1, 4.2, 5.1, 5.2 preferably have a dedicated power drive. The stacking of the rolls of a roll stack can be arranged vertically, horizontally or obliquely.

The roll stack can be loaded by at least one end-side loading cylinder and/or by individual loading elements which act on the rolls 4.1, 4.2, 5.1, 5.2 and by way of which the respective line load in the working nips can be set. The calender can be used online or offline.

The nip length of the soft nips 3 preferably lies in the range from 3 to 40 mm, depending on the type of roll as a soft roll or as a shoe roll with an elastic belt. The heated end roll 4.1 is heated, for example, to roll surface temperatures from 80° C. to 160° C. as a function of the plasticization temperature of the respective paper web 2 and its moisture content.

The contact face 9 is a circulating contact face which is formed by a belt 14 which circulates on the guide rolls 11, 12, 13. The other contact face 10 is formed by the circulating outer wall of the hard, heated roll 4.1. The web treatment nip 8 extends along an angle of the wrap of the heated roll 4.1. The angle of the wrap for varying the length of the web treatment nip 8 can be set as a function of a desired penetration depth of the heat into the paper web 2. The selectable dwell time is optimized by means of the guide rolls 11, 12, 13 by adjustment of the pressing length of the belt 14 on the circumference of the heated end roll 4.1. The pressing length on the circumference of the roll 4.1 can preferably be set variably from 0.25 to 5.0 m.

The circulating belt 14 presses the paper web 2 against the heated roll 4.1 with an elastic surface in order to increase the degree of thermal efficiency of the heat transfer.

The contact pressure in the web treatment nip 8 is set by the tensioning of the belt 14. The maximum tensile stress of the belt 14 is limited to preferably 200 kN/m. The compressive stress which can be achieved in the pretreatment zone of the web treatment nip 8 can assume, for example, a value in the range from 0.01 MPa to 0.5 MPa. This depends on the belt tensioning and the selected dimensions of the heated end roll 4.1.

Before entry into the web treatment nip 8, the web 2 can wrap around the heated end roll 4.1 along a part section.

The surface temperature of the heated end roll 4.1 is preferably regulated in such a way that, within the dwell time of the web 2 below the belt 14, the glass transition temperature is achieved in an optimum penetration depth for the respective aim of the calendering operation. For high calendering, a penetration depth of approximately 10 μm is sufficient. The surface temperature and the length of the pretreatment section of the web treatment nip 8 are optimized in such a way that operation is made possible at a temperature which does not substantially exceed the glass transition temperature of the surface region to be plasticized of the web 2. The web 2 which has been pretreated in this way and can be dampened upstream of the calender 1 with nozzle and/or steam moisteners is calendered directly behind the pretreatment section in the nip 3 and the following nips. The nip 3 is arranged immediately behind the wrapped section on the heated end roll 4.1. Moistening behind the calender 1 or between two calenders 1 is also possible if this is required technologically.

The circulating belt 14 preferably has an elastic surface for ensuring a uniform contact pressure which can be set by the tensioning of the belt 14. The heat transfer emanating from the heated end roll 4.1 to the paper web 2 is shielded thermally in the web treatment nip 8 with respect to the surroundings by the circulating belt 14 which is configured in this way. The introduction of heat into the paper web 2 is improved, since heat dissipation to the surroundings is reduced. If the elastic surface is a thermal insulator, the introduction of the heat into the paper web 2 is improved further. The elastic surface of the circulating belt 14 therefore preferably consists of a material with a thermal conductivity of less than or equal to 10 W/mK, in particular less than or equal to 5 W/mK, very preferably less than or equal to 1 W/mK. The hardness of the elastic surface preferably lies in the range from 50 Shore A to 92 Shore D.

The belt 14 preferably consists of a flat carrier material which is provided with one or more elastic layers. High strength plastic fibers, glass fibers or carbon fibers can be used as carrier material. A composite material of this type has a high tensile strength. In order to increase the mechanical strength of the belt, a supporting fabric or supporting belt made from the abovementioned fibers can also be incorporated. Furthermore, the circulating belt 14 can consist of a carrier material which is provided with an elastic layer, it also being possible for the carrier material to consist of a metal or metal strip. In the case of a sufficiently thin, elastic layer, the hardness of the metal can ensure calendering of that side of the paper web 2 which faces the circulating belt 14. The roughness of the elastic surface of the belt 14 preferably lies in the range from 0.5 to 5 μm. The smoothness then existing of the elastic surface of the belt 14 can be reproduced as smoothness on the paper web 2. The belt 14 has, for example, a heat resistant surface coating, for example made from silicone. The heat resistant coating affords high wear strength and a smooth surface.

The pretreatment section of the web treatment nip 8 also serves, in particular, to presmooth the web 2.

Furthermore, the circulating belt 14 preferably only has a low expansion which is less than or equal to 7%. The expansion which occurs during setting of the belt tension in the belt 14 on account of tensile stress in the belt 14 then does not disrupt the calendering. The belt 14 has at least the same width as the web 2. The thickness of the belt 14 depends on its width and length and can be between 4 and 20 mm.

At least one of the guide rolls 11, 13 can be configured as a pressing roll which presses the web 14 in the web treatment nip 8 along a section in the running direction L by way of additional radial pressure loading. A guide roll 11, 13 is preferably configured as a pressing roll on the inlet and/or outlet side of the web treatment nip 8. Here, the radial pressure loading can be set to be lower on the inlet side than on the outlet side, or vice versa. A pressing roll of this type can be a controlled deflection roll.

FIG. 1 shows a calender 1, in which the belt 14 wraps around the heated, hard roll 4.1 by more than 60°. The angle of wrap preferably lies at values between 60° and 270°. The circulating, endless belt 14 is guided by three guide rolls 11, 12, 13 in a loop around the heated roll 4.1. Here, the belt 14 is tensioned by the guide roll 12. The contact pressure of the belt 14 onto the web 2 is defined by this tensioning. Greater tensioning of the belt 14 also results in a greater contact pressure of the web 2 and promotes the flattening of the web surface, that is to say the presmoothing.

The web 2 which is conditioned in the web treatment nip 8 is finally calendered in a directly following nip 3 which is formed with the same heated roll 4.1 and in the following nips, formed by the rolls 5.1, 5.2 and 4.2. The line loads in this nip sequence can be adapted to the calendering effects to be achieved. Mean compressive stresses with paper in the nip from 2 N/mm$^2$ to 55 N/mm$^2$ can be set. The compressive stresses in the upper region of the stated range make the calendering of high quality papers possible, such as SC, LWC and MWC papers or wood-free coated papers. Exact profile regulation is possible by direct pressing of the two rolls 4.1 and 5.1, without a belt 14 being guided between them. Any possibly existing thickness differences of the belt 14 on account of production tolerances or thermal expansion do not affect the calendering result.

Since the temperature of the heated end roll 4.1 and the length of the treatment section which is formed under the belt 14 are set in such a way that substantially only that region of the web 2 which is close to the surface is heated, a conditioning section is produced, in which the interior of the web 2 remains below the plasticization or glass transition temperature. The thickness of that layer of the web 2 which is close to the surface and is heated above the plasticization temperature is many times greater than the largest unevennesses of the paper web surface. The thickness of the layer to be heated is therefore dependent on the roughness of the web 2 to be treated. The length of the web treatment nip 8 and the speed of the web 2 in the running direction L define the dwell time of the web 2 in the web treatment nip 8 and therefore also the penetration depth of the heat into the web 2 and the layer thickness which is heated to a deformation temperature.

The surrounding air which is entrained with the web 2 in the boundary layer impairs the heat transfer from the heated end roll 4.1 to the web 2. A substantial improvement of the heat transfer is achieved by removal of the boundary layer. This can take place, for example, by way of a contact section for adhering contact between the outer wall of the heated end roll 4.1 and the surface of the paper web 2 on the inlet side upstream of the web treatment device 7. Furthermore, pressing a guide roll 11 against the heated end roll 4.1 is suitable. As a result of these measures, the disruptive boundary layer can be displaced counter to the running direction of the web 2 and the heat transfer in the web treatment nip 8 can be increased further.

FIG. 2 shows a calender arrangement with two roll stacks of a calender 1 which are arranged behind one another in the running direction of the web 2. As a result, calendering of the web 2 on both sides is possible. In the calender arrangement which is shown, first of all the lower web side is calendered in the nips of the first roll stack and subsequently the upper web side is calendered in the nips of the second roll stack. The temperatures of the heated rolls 4.1, 5.2 and the line loads in the two roll stacks can be set independently of one another. As a result, the two-sidedness of the web 2 in relation to the calendering result (different smoothness of the two sides of a web) can be minimized or, if desired, a targeted two-sidedness can also be set. As an alternative, the upper web side can also be calendered first of all.

FIG. 3 shows a multinip calender with a plurality of hard, heated intermediate rolls 5.1, 5.3, the diameter of all of which is smaller than that of the upper end roll 4.1 which delimits the first nip 3. The same applies to an alternative exemplary embodiment, in which the lower end roll 4.2 delimits the first nip 3. Otherwise, the above explanations apply correspondingly. The number of nips and the rolls which form them is determined by the smoothness to be achieved of the paper web 2. FIG. 3 shows a roll stack with six rolls. As an alternative, the roll stack can also comprise 8 or 10 rolls.

According to a further exemplary embodiment (not shown), an additional web treatment nip can be provided at a heated intermediate roll 5.2, 5.4.

In the case of exemplary embodiments described in the preceding text, the belt 14 can be cooled outside the web treatment nip 8. The return region of the belt 14 can be provided as a position for the cooling.

The invention claimed is:

1. A calender for calendering a paper web, in particular made from paper suitable for gravure printing, having at least one roll stack which in each case has an upper and a lower end roll and intermediate rolls, one of the two end rolls delimits a first working nip of the roll stack depending on the guidance of the paper web, and the rolls are hard rolls and soft rolls in order to form loadable working nips in the form of soft nips, wherein in that the end roll which delimits the first working nip is a hard, heated roll, the diameter of which is greater than that of a hard, heated intermediate roll and the outer wall of which forms one of two contact faces of a web treatment nip which is arranged upstream of the first working nip, and the other contact face is formed by a belt which circulates on guide rolls, wherein the hard, heated intermediate roll comprises a plurality of openings therein for heating the outer surface of the hard heated intermediate roll to a temperature at least slightly higher than a plasticization temperature of the paper web at a selected moisture content.

2. The calender as claimed in claim 1, wherein the web treatment nip extends along an angle of the wrap of the hard, heated end roll.

3. The calender as claimed in claim 1, wherein the circulating belt has an elastic surface on the side which faces the paper web.

4. The calender as claimed in claim 1, wherein the guide rolls control belt tensioning of the belt for pressure loading in the web treatment nip.

5. The calender as claimed in claim 1, wherein the diameter of the end roll which delimits the first working nip lies in the range from 1.2 m to 2.0 m.

6. The calender as claimed in claim 1, wherein the diameter of a hard, heated intermediate roll lies in the range from 0.6 to 1.2 m.

7. The calender as claimed in claim 1, wherein the elastic surface of the belt consists of a material with a thermal conductivity of less than or equal to 10 W/mK.

8. The calender as claimed in claim 1, wherein at least one guide roll is configured as a pressing roll which presses the web in the web treatment nip along a section in the passage direction by way of the use of additional radial pressure.

9. The calender as claimed in claim 1, wherein a contact section for adhering contact between the outer wall of the heated end roll and the surface of the paper web is arranged upstream of the web treatment nip on the inlet side.

10. The calender as claimed in claim 1, wherein the calender has two roll stacks with in each case one web treatment nip upstream of the first working nip.

11. The calender as claimed in claim 10, wherein in one roll stack, the upper end roll delimits the first working nip and, in the other roll stack, the lower end roll delimits the first working nip.

12. The calender as claimed in claim 1, wherein like the first working nip, the lengths of the soft nips lie in the range from 3 to 40 mm.

13. The calender as claimed in claim 1, wherein all the rolls have a dedicated power drive.

14. The calender as claimed in claim 1, wherein a stacking of a roll stack is arranged vertically, horizontally or obliquely.

15. The calendar as in claim 1, wherein the heater comprises a forced convection heater.

16. The calendar as in claim 1, wherein the heater heats the outer surface to a temperature in the range from 80° C. to 160° C.

17. A method for calendaring a paper web, comprising;

providing a calendar that comprises a calender for calendering a paper web, in particular made from paper suitable for gravure printing, having at least one roll stack which in each case has an upper and a lower end roll and intermediate rolls, one of the two end rolls delimits a first working nip of the roll stack depending on the guidance of the paper web, and the rolls are hard rolls and soft rolls in order to form loadable working nips in the form of soft nips, wherein the end roll which delimits the first working nip is a hard, heated roll, the diameter of which is greater than that of a hard, heated intermediate roll and the outer wall of which forms one of two contact faces of a web treatment nip which is arranged upstream of the first working nip, and the other contact face is formed by a belt which circulates on guide rolls;

directing the paper web over an outer surface of the hard, heated intermediate roll while the temperature of the outer surface is in the range from 80° C. to 160° C.;

maintaining the paper web against the outer surface for a contact distance in the range from 0.2 m to 5.0 m.

* * * * *